US007708270B2

(12) United States Patent
Andersen et al.

(10) Patent No.: US 7,708,270 B2
(45) Date of Patent: May 4, 2010

(54) SYSTEM AND METHOD FOR HANDLING PRINT MEDIA

(75) Inventors: Eric L. Andersen, Meridian, ID (US); Wesley Alan Fujii, Boise, ID (US); Anthony J. Sanchez, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1457 days.

(21) Appl. No.: 10/627,560

(22) Filed: Jul. 25, 2003

(65) Prior Publication Data

US 2005/0017427 A1 Jan. 27, 2005

(51) Int. Cl.
*B65H 29/00* (2006.01)

(52) U.S. Cl. ..... 271/186; 271/65

(58) Field of Classification Search ..... 271/65, 271/186, 291; 399/391, 392, 401, 364, 107, 399/110; 270/58.07, 58.08
See application file for complete search history.

(56) References Cited

U.S. PATENT DOCUMENTS 4,348,101 A * 9/1982 Schonfeld et al. ..... 399/401
4,365,886 A * 12/1982 Murakami et al. ..... 399/391
4,918,490 A * 4/1990 Stemmle ..... 399/401
4,928,128 A * 5/1990 Stemmle ..... 399/364
5,042,791 A * 8/1991 Stemmle ..... 271/186
5,724,642 A * 3/1998 Cala ..... 399/364
5,882,005 A 3/1999 Araseki et al.
6,144,814 A * 11/2000 Newell et al. ..... 399/16
6,267,368 B1 * 7/2001 Tomoe et al. ..... 271/9.09
6,308,948 B1 * 10/2001 Azumi ..... 271/207
6,350,072 B1 * 2/2002 Nunes et al. ..... 400/188
6,549,748 B2 * 4/2003 Miura ..... 399/401

FOREIGN PATENT DOCUMENTS

JP 61-4080 * 1/1986
JP 3-174170 * 7/1991

OTHER PUBLICATIONS

Xerox Document Centre 555/545/535 Specifications, Sep. 2002.
Xerox Document Centre 440 & 432 Specifications, Dec. 7, 2001.
Xerox Document Centre 440/432/425 Specifications, Jul. 2001.

* cited by examiner

*Primary Examiner*—Patrick H Mackey
*Assistant Examiner*—Thomas A Morrison

(57) ABSTRACT

In one embodiment, a media handling system is provided to transfer media through an image forming device having a primary media path and a duplex media path. The media handling system includes a media feeder configured to input media into the duplex media path of the image forming device.

21 Claims, 5 Drawing Sheets

SYSTEM AND METHOD FOR HANDLING PRINT MEDIA

BACKGROUND

Some image forming devices are equipped with large capacity media storage units to house non-imaged print media to be used as input. The storage units were typically positioned on one side of the image forming device while the print media was discharged to an output device positioned generally on an opposite side of the image forming device. As such, these image forming devices have a large footprint and use a large area of floor space which may not be available in small rooms.

BRIEF DESCRIPTION OF THE DRAWINGS

It will be appreciated that the illustrated boundaries of elements (e.g. boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa.

DETAILED DESCRIPTION OF ILLUSTRATED EMBODIMENTS

Figure 1:
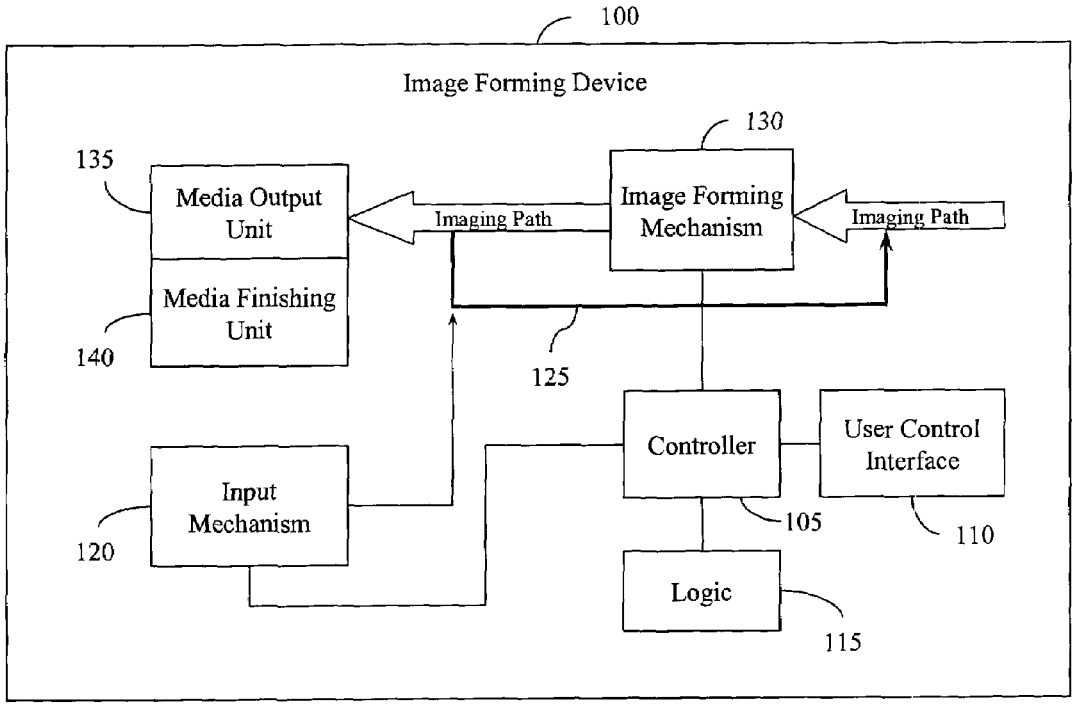
FIG. 1 is a system diagram of one embodiment of an image forming device.

The following includes definitions of selected terms used throughout the disclosure. The definitions include examples of various embodiments and/or forms of components that fall within the scope of a term and that may be used for implementation. Of course, the examples are not intended to be limiting and other embodiments may be implemented. Both singular and plural forms of all terms fall within each meaning:

"Image", as used herein is used generally to represent any markings such as text, graphics or other markings placed on media.

"Logic", as used herein, includes but is not limited to hardware, firmware, software and/or combinations of each to perform a function(s) or an action(s), and/or to cause a function or action from another component. For example, based on a desired application or need, logic may include a software controlled microprocessor, discrete logic such as an application specific integrated circuit (ASIC), a programmable/programmed logic device, memory device containing instructions, or the like. Logic may also be fully embodied as software.

"Signal", as used herein, includes but is not limited to one or more electrical signals, analog or digital signals, one or more computer or processor instructions, messages, a bit or bit stream, or other means that can be received, transmitted, and/or detected.

"User", as used herein, includes but is not limited to one or more persons, software, computers or other devices, or combinations of these.

In one embodiment, an image forming device includes a media handling system configured to reduce a footprint of the image forming device. For example, the image forming device can include a primary media path along which print media is imaged and a duplex media path that is configured to return the imaged print media back to the primary media path for double-sided imaging. The duplex media path is also configured to accept non-imaged print media as input.

In other words, non-imaged print media can be inputted directly from a media feeder into the duplex media path of the image forming device. The media can be configured to travel along the duplex media path and transfer into the primary media path for imaging. Once imaged, the imaged media can be discharged from the image forming device to an output device that can be configured on the same side as the media feeder. This configuration, for example, allows the image forming device to be configured with a smaller footprint for areas with limited space.

Additionally, the following embodiments describe a "duplex" or otherwise "return" media path configured to process print media during double-sided imaging requests. It will be appreciated that the present system is applicable to any image forming device containing a primary media path and a "return" media path. In other words, it is not necessary that the "return" media path be a "duplex" media path used for double-sided imaging. For instance, one embodiment may be configured to use a "return" media path through which media is cycled within the image forming device for additional same-side imaging. Examples of same-side imaging may include multi-color imaging, enhanced imaging and the like. It will be appreciated that a return media path can generally be regarded as a path configured to carry print media from an output side of the imaging process back to an input side. The return path may also be separate from a duplex path if desired.

Illustrated in FIG. 1 is a simplified component diagram of one embodiment of an image forming device 100. For example, the image forming device 100 may be a copier, multi-functional peripheral device, all-in-one product, or other device that images media and includes a duplex media path (not in figure). The image forming device components generally represent the image forming device 100 and may have any desired configuration.

The image forming device 100 can include a controller 105 to control and coordinate the operations within the image forming device 100 in accordance with predetermined rules and selected imaging options. For example, the imaging options may be inputted by a user via a user control interface 110. Of course, default settings and parameters may be used, thus, not requiring additional imaging options to be received from a user. The controller 105 may be embodied as logic and may include logic 115, such as firmware, to maintain software instructions or other data. For example, the controller 105 can control flow of media through the image forming device based on one or more printing parameters to accomplish single-sided or double-sided (duplex) imaging, to identify the location of a desired input source to receive print media, or to perform other tasks as desired.

The image forming device 100 can also include an input mechanism 120 to input print media for imaging. The input mechanism 120 may be configured to permit manual or automatic feed of print media. In one embodiment, the input mechanism 120 may be configured to input non-imaged media directly into a return media path 125 that carries the inputted print media to an imaging path.

The image forming device 100 also includes an image forming mechanism 130 where an image is formed onto the print media. Once imaged, the imaged print media can exit the image forming mechanism 130 to a media output unit 135 such as an output bin or tray. The media output unit 135 may include a media finishing unit 140 configured to organize the imaged media. For example, the media finishing unit 140 may perform tasks such as a collecting, sorting, collating, stapling, hole punching and the like.

Figure 2:
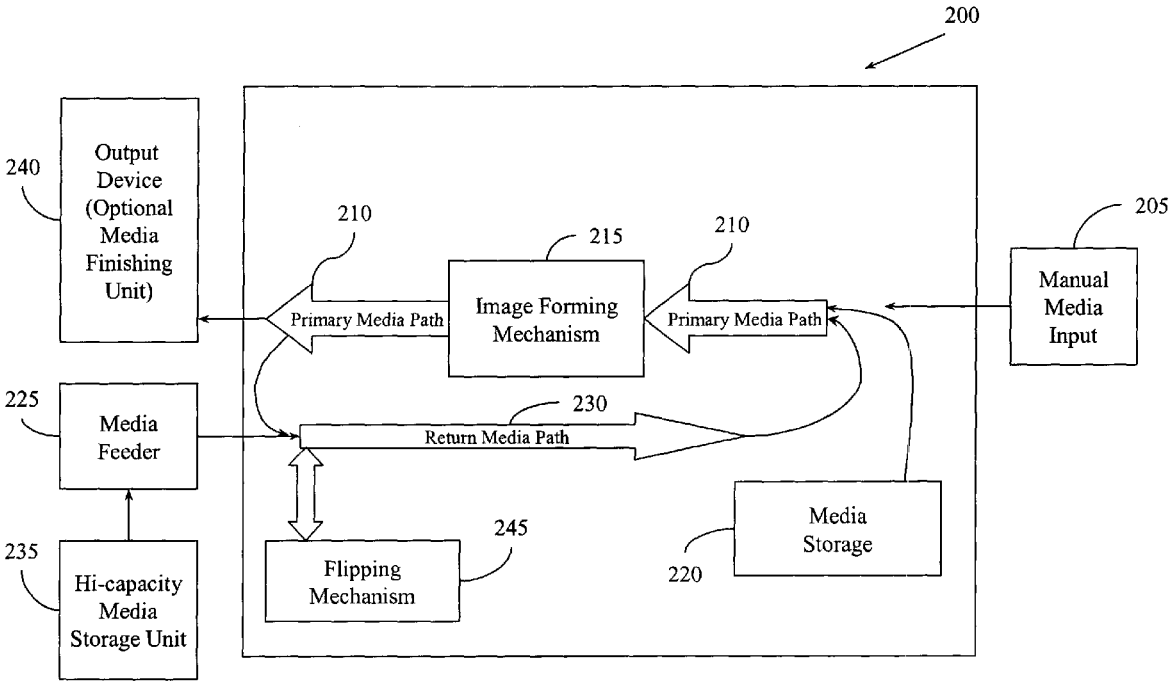
FIG. 2 is a system diagram of one embodiment of an image forming device which illustrates an example of media flow.

The operation and directional flow of media will be better understood with reference to FIG. 2. FIG. 2 illustrates a simplified component diagram of one embodiment of an image forming device 200. The illustrated components represent a logical representation of the image forming device 200 which may not correspond to a specific physical arrangement and positioning of components. Additionally, FIG. 2 illustrates one embodiment identifying the media flow through the image forming device 200.

In one embodiment, the image forming device 200 can include a manual media input 205 configured to input print media directly into a primary media path 210. The image forming device 200 is configured to carry the print media along the primary media path 210 and through an image forming mechanism 215 where an image is generated onto the print media. The image forming device 200 can also include one or more print media sources such as media storage 220.

The image forming device 200 can also be configured to input print media directly into a return media path 230 via a media feeder 225. It will be appreciated that the media feeder 225 may be configured to feed media into the image forming device 200 either manually or automatically as desired. Further, it will be appreciated that a high-capacity media storage unit 235 may be used in connection with the media feeder 225 in order to store a quantity of non-imaged print media for input.

Once the print media enters the return media path 230, the print media is transferred along the return media path 230 and into the primary media path 210. It will be appreciated that a variety of mechanisms may be used to move the media along the media paths 210 and 230 including rollers, belts and the like.

Upon transfer into the primary media path 210, the non-imaged print media is carried along the primary media path 210. While traveling through the primary media path 210, the media passes through the image forming mechanism 215 which forms an image onto the media. In one embodiment, the image forming mechanism 215 may include a laser imaging mechanism. The laser imaging mechanism may include a replaceable cartridge that includes one or more imaging components such as a photosensitive drum, a charging roller, a transfer roller, and toner. After being imaged, the media passes through a fuser (not shown) that fuses the image to the media. Of course, other types of components may be used depending on the type of image forming device 200.

If the image forming device 200 is processing a single-sided imaging request, the imaged media would then be completed and discharged from the image forming device 200 into an output device 240 such as a tray or bin. It will be appreciated that the output device 240 can be configured with an optional media finishing unit. If the image forming device 200 is processing a duplex or double-sided imaging request, the media would be imaged again on its reverse side. For example, the single-sided imaged media is carried into a flipping mechanism 245, flipped and returned back into the return media path 230 in order to prepare the media for reverse side imaging. As previously described, the media is carried along the return media path 230 and inputted back into the primary media path 210. The media is then moved along the primary media path 210 and the reverse side of the media is imaged when passed through the image forming mechanism 215. Upon completion of the imaging, the double-sided imaged media is discharged from the image forming device 200 to the output device 240. In this manner, the media feeder 225 and the output device 240 can be configured on the same side of the image forming device 200. By putting these components on the same side, the footprint of the image forming device 200 can be reduced.

Figure 3:
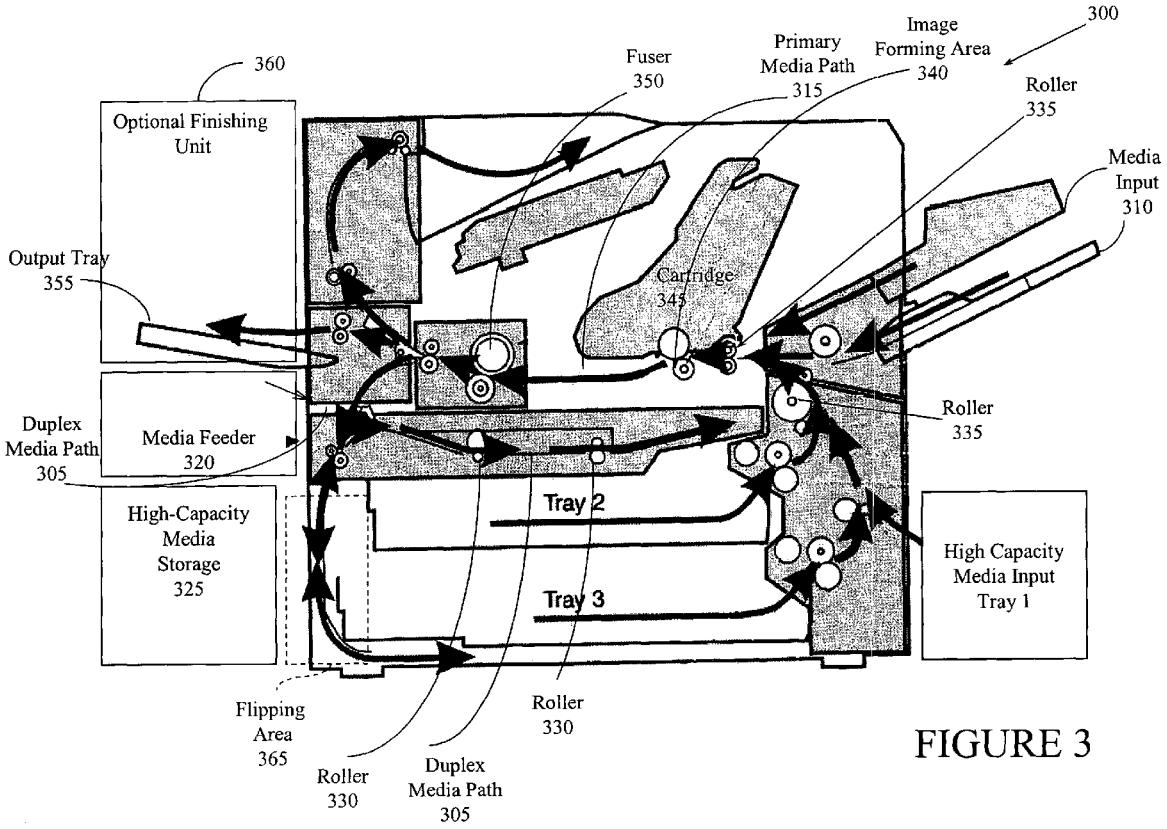
FIG. 3 is a cross-sectional view of an image forming device illustrating another embodiment of media flow.

With reference to FIG. 3, a cross-sectional view of a more detailed embodiment of an image forming device 300 is shown. The image forming device 300 can be configured to receive print media from multiple input sources. For example, print media can be received from a manual media input tray 310, a traditional automatic high capacity media input tray 1 and one or more automatic feed trays 2 and 3. In this embodiment, the image forming device 300 is configured to selectively input print media from these trays into a primary media path 315 along which an image is formed on the print media. A duplex media path 305 can also be included that is configured to return imaged print media back to the primary media path 315 for additional imaging operations, such as duplex imaging.

The image forming device 300 can also include a media feeder 320 as an input source configured to input print media directly into the duplex media path 305 rather than the primary media path 315. The duplex media path 315 can then be used to carry the print media (e.g. non-imaged print media) to the primary media path 315 for imaging. It will be appreciated that media feeder 320 can be configured to input print media into the duplex media path 305 at a point near or adjacent an output point where imaged print media is discharged. In this manner, the media feeder 320 and an output tray 355 (e.g. print media input and output components, respectively) can be positioned on the same side of the image forming device 300 which can reduce floor space required by the image forming device 300.

In one embodiment, the duplex media path 305 can be configured to carry print media in a substantially horizontal direction which is generally parallel to a surface (e.g. a floor) onto which the image forming device 300 is positioned. Of course, in other configurations, the duplex media path 305 may be configured with non-horizontal portions and variations along its directional movement of the media through the image forming device 300. A series of rollers 330 can be positioned along the duplex media path 305 that are configured to move the print media. It will be appreciated that other mechanisms may be used to move the media through the image forming device 300 such as rollers, belts and the like, and combinations of these mechanisms.

It will be appreciated that the media feeder 320 may be configured to feed media into the image forming device 300 either manually or automatically as desired. Further, it will be appreciated that a high-capacity media storage unit 325 may be used in connection with the media feeder 320 in order to store a quantity of non-imaged print media for input.

Once print media enters the duplex media path 305 from the media feeder 320, the media is carried along the duplex media path 305 back to the primary media path 315. The non-imaged media is then moved along the primary media path 315 by, for example, a series of rollers 335. While traveling through the primary media path 315, the media passes through an image forming area 340 where an image is formed onto the print media. In one embodiment, the image forming area 340 includes a laser imaging mechanism. The laser imaging mechanism can include a replaceable print cartridge 345 that includes one or more imaging components such as a photosensitive drum, a charging roller, a transfer roller, and toner. After being imaged, the media passes through a fuser 350 that fuses the image to the media. Of course, other types of components may be used depending on the type of image forming device 300.

If processing a single-sided imaging request, the imaged media would then be completed and discharged from the image forming device 300 into the output tray 355. It will be appreciated that the output tray 355 may be replaced with or include an optional media finishing unit 360 to receive, process, and organize the discharged media.

If processing a duplex or double-sided imaging request, the image forming device 300 would return and image the print media again on its reverse side. For example, the single-sided imaged media is carried into a flipping area 365, flipped and returned back into the duplex media path 305 in order to prepare the media for reverse side imaging. The media is moved along the duplex media path 305 and back into the primary media path 315. The media is then moved along the primary media path 315 and the reverse side is imaged by the imaging mechanism(e.g., the print cartridge 345) as described above. Upon completion of the imaging, the now double-sided imaged media is discharged from the image forming device 300 into the output tray 355.

Figure 4:
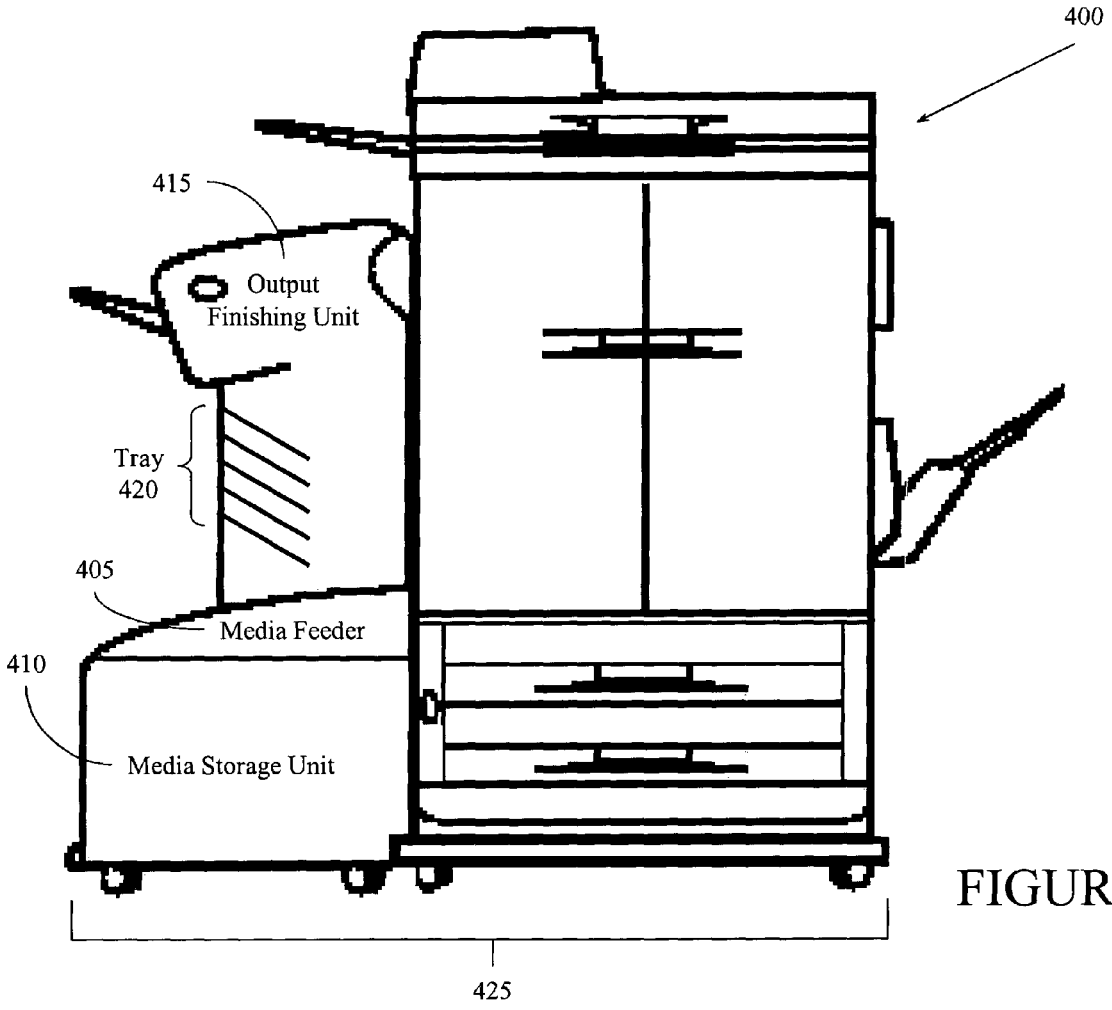
FIG. 4 is a front view of an image forming device in accordance with an alternate embodiment configured to have a reduced footprint.

Illustrated in FIG. 4 is an alternative embodiment of an image forming device 400 equipped with an optional media feeder 405 used in conjunction with a high-capacity media storage unit 410. In this alternative embodiment, the high capacity media storage unit 410 is configured to store a quantity of print media for use in the image forming device 400. The media storage unit 410 may include a tray (not shown) for holding the print media and one or more belts that support and move the tray. For example, as the print media is taken out of the storage unit 410 by the media feeder 405, the tray is lifted towards the media feeder 405 so that the next sheet of print media is positioned to be taken by the feeder 405. It will be appreciated that other methods of transferring media from the high-capacity media storage unit 410 into the media feeder 405 may be used.

The optional output finishing unit 415 can include a series of trays or bins 420 in order to organize media discharged from the image forming device 400. For example, the output finishing unit 415 may be configured to collate discharged media into the series of trays or bins 420.

With continued reference to FIG. 4, the image forming device 400 may be configured to have the media feeder 405, high-capacity media storage unit 410 and the output finishing unit 415 vertically stacked to reduce the overall footprint 425 of the image forming device 400. To allow the media feeder 405 and the output unit to be on the same side of the image forming device 400, the media feeder 405 is configured to input print media into a duplex media path as described previously. In one embodiment, the media feeder 405, high-capacity media storage unit 410 and the output finishing unit 415 may be an integral unit contained within a common housing. It will be appreciated that the media feeder 405, the high-capacity media storage unit 410 and the output finishing unit 415 can be configured as separate components, or a combination of separate/integral components. Furthermore, depending on the configuration, the components may be attachable/detachable together or separately from the image forming device 400. Having removable components may assist in handling the image forming device 400 in situations such as servicing, repairing, packaging, or transporting the device 400.

The embodiments previously shown describe an image forming device configured to accept media inputted directly into the duplex media path. In another embodiment, an existing image forming device may be retrofitted or otherwise re-configured to accept print media directly into the duplex media path. For example, retrofitting may include creating an opening in or removing a side wall from an image forming device so as to provide access to the duplex or return media path. A media feeder can then be attached and configured to supply print media directly into the duplex media path as described above. Firmware of the image forming device can then be modified to control media input to the duplex path, for example, as described with reference to FIG. 5.

Figure 5:
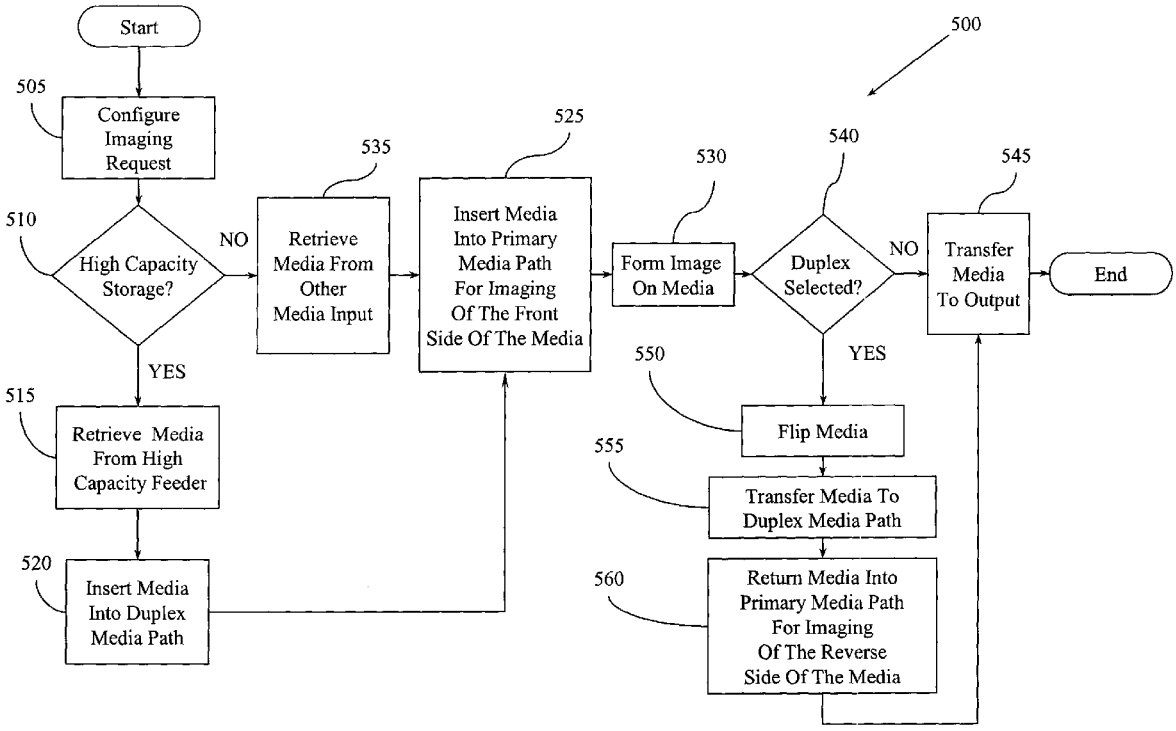
FIG. 5 illustrates one embodiment of a methodology for feeding media through an image forming device.

Illustrated in FIG. 5 is one embodiment of a methodology 500 associated with processing an imaging request by inputting print media through a duplex media path of an image forming device. The illustrated elements denote "processing blocks" and represents instructions or groups of instructions that cause a processor, mechanism, or other device to perform a function, an action, and/or to make a decision. Alternatively, the processing blocks may represent functions and/or actions performed by functionally equivalent circuits such as a digital signal processor circuit, an application specific integrated circuit (ASIC), or other logic device. The diagram, as well as the other illustrated diagrams, does not depict syntax of any particular programming language. Rather, the diagram illustrates functional information one skilled in the art could use to fabricate circuits, generate computer software, or use a combination of hardware and software to perform the illustrated processing. It will be appreciated that electronic and software applications may involve dynamic and flexible processes such that the illustrated blocks can be performed in other sequences different than the one shown and/or blocks may be combined or separated into multiple components.

With reference to FIG. 5, the methodology will be described with reference to an image forming device configured with a high capacity media storage unit and feeder. The image forming device is configured with a primary media path where media is imaged and a duplex media path configured to transfer media into the primary media path for initial imaging and carry imaged print media back to the primary media path for additional imaging.

The process is commenced upon receiving an imaging request (block 505). The imaging request may include one or more user selected imaging options, default imaging options, or a combination of both. Print media can be selected from a designated source based on the imaging options. At block 510, the media source is determined, such as, whether the high capacity storage is to be used. The decision at block 510 may also be based on a type of input mechanism to be used during imaging, for example, the high capacity feeder.

If the high-capacity media storage unit is the media input source, the media is retrieved from the high capacity storage unit (block 515) and directly inputted into the duplex media path (block 520). In other words, the inputted media initially by-passes the primary media path. The inputted media is then carried along the duplex media path and transferred to the primary media path (block 525) where an image is formed onto the media (block 530).

If, at block 510, the media is to be inputted from a source other than the high-capacity media storage unit, the media is retrieved from the other source (block 535) and transferred directly into the primary media path for imaging (block 530). In either scenario, once the media is imaged, the process determines whether a single or double-sided (duplex) imaging request is being processed (block 540).

If single-sided imaging is being performed, the imaged media is completed and is discharged to an output (block 545). The discharged media may then be finished with a desired finishing operation if available.

If, at block 540, duplex imaging is being performed, the single-sided imaged media is flipped (block 550) so that imaging can be performed on its reverse side. Once flipped, the media is moved through the duplex media path (block 555) which carries the media back to the primary media path for reverse side imaging (block 560). The reverse side is then imaged. Following completion of the double-sided imaging request the imaged media is discharged to an output (block 545).

Although the described embodiments refer to the imaging forming function taking place along the primary media path, it will be appreciated that an image forming device may be configured to image the media in other areas located within the image forming device. For example, the image forming device may be configured to image the media along the duplex media path or between the primary and duplex media paths without departing from the scope and function of the present system.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

We claim:

1. A media handling system for an image forming device configured with a primary media path and a duplex media path, the media handling system comprising:

a media feeder positioned adjacent to one side of the image forming device and configured to input print media into the duplex media path of the image forming device, and the media feeder being positioned to not be part of the duplex media path.

2. The media handling system as set forth in claim 1 wherein the duplex media path is a substantially horizontal media path.

3. The media handling system as set forth in claim 1 wherein the media feeder is configured to automatically input non-imaged media into the duplex media path of the image forming device.

4. The media handling system as set forth in claim 1 wherein the media feeder includes a high-capacity media storage unit to store a quantity of media.

5. The media handling system as set forth in claim 1 wherein the media feeder is configured to be detachably mounted to the one side of the image forming device.

6. The media handling system as set forth in claim 1 further comprising a media output unit configured to be positioned adjacent to the one side of the image forming device to receive media discharged from the image forming device.

7. The media handling system as set forth in claim 6 wherein the media feeder and the media output unit are configured to be vertically-stacked to reduce a footprint of the image forming device.

8. The media handling system as set forth in claim 6 wherein the media feeder and the media output unit are integral within a housing.

9. The media handling system as set forth in claim 6 wherein the media output unit includes a media finishing device.

10. A media handling apparatus for inputting non-imaged media into an image forming device having a primary media path along which an image is formed on a print media, the handling apparatus comprising:

a return media path configured to selectively receive imaged print media from the primary media path and return the imaged media to the primary media path for multiple imaging;

a media input unit configured for attachment to one side of the image forming device to input non-imaged media into the return media path of the image forming device, where the media input unit is positioned where the return media path does not return the imaged media across the media input unit during duplex printing; and a media output unit for receiving imaged media discharged from the primary media path, the media output unit being configured for attachment to the one side of the image forming device and stacked above the media input unit.

11. The media handling apparatus as set forth in claim 10 wherein the return media path is a substantially horizontal path.

12. The media handling apparatus as set forth in claim 10 wherein the media input unit further comprises a media storage unit to store a quantity of non-imaged media.

13. The media handling apparatus as set forth in claim 10 wherein the media output unit includes a media finishing device.

14. The media handling apparatus as set forth in claim 10 wherein the media input unit is configured to be detachably mounted to the one side of the image forming device.

15. The media handling apparatus as set forth in claim 10 wherein the media input unit and the media output unit are integral within a common housing.

16. An image forming apparatus comprising:

a housing having at least one wall;

an image forming unit provided within the housing for forming an image onto print media;

a media storage unit configured to store a supply of non-imaged print media;

a primary media path for carrying print media to the image forming unit for imaging;

a duplex media path configured to receive imaged print media from the primary media path and return the imaged print media to the primary media path for duplex imaging where the returned imaged media is not returned to the media storage unit during the duplex imaging; and the duplex media path being configured to receive non-imaged print media from the media storage unit and to input the non-imaged print media to the primary media path for imaging.

17. The image forming apparatus as set forth in claim 16 further comprising a media output unit positioned to receive imaged print media discharged from the primary media path where the media storage unit and the media output unit are stacked to reduce a footprint of the image forming apparatus.

18. The image forming apparatus as set forth in claim 16 further including a media feeder to feed the non-imaged print media from the media storage unit to the duplex media path.

19. The image forming apparatus as set forth in claim 17 wherein the media storage unit and the media output unit are contained within a common housing.

20. The image forming apparatus as set forth in claim 16 wherein the media output unit includes a media finishing unit.

21. The image forming apparatus as set forth in claim 16 further comprising logic to determine whether print media is inputted into the primary media path or the duplex media path.

* * * * *